US007134927B1

(12) United States Patent
Johnson

(10) Patent No.: US 7,134,927 B1
(45) Date of Patent: Nov. 14, 2006

(54) HEEL MOUNTED DIRECTION REVERSIBLE STEALTH FIN

(75) Inventor: Carroll L. Johnson, Grand Junction, CO (US)

(73) Assignee: Dux Fin Co., Grand Junction, CO (US)

( * ) Notice: Subject to any disclaimer, the term of this patent is extended or adjusted under 35 U.S.C. 154(b) by 0 days.

(21) Appl. No.: 11/198,766

(22) Filed: Aug. 5, 2005

Related U.S. Application Data

(60) Provisional application No. 60/599,489, filed on Aug. 6, 2004.

(51) Int. Cl.
*A63B 31/08* (2006.01)

(52) U.S. Cl. ..... 441/64

(58) Field of Classification Search ..... 441/61–64; D21/806

See application file for complete search history.

(56) References Cited

U.S. PATENT DOCUMENTS

| | | | |
|---|---|---|---|
| 1,794,883 | A | 3/1931 | Corder et al. |
| 2,395,844 | A | 3/1946 | Bufkin |
| 3,082,422 | A | 3/1963 | Cousteau et al. |
| 3,204,951 | A | 9/1965 | Grain |
| 3,268,927 | A | 8/1966 | Markowitz |
| 4,664,639 | A | 5/1987 | Schneider |
| 5,338,235 | A | 8/1994 | Lee |
| 5,531,621 | A | 7/1996 | Johnson |
| 5,593,333 | A | 1/1997 | Johnson |
| 5,645,460 | A | 7/1997 | Johnson |
| 6,077,139 | A | 6/2000 | Celik |
| 6,227,923 | B1 | 5/2001 | Johnson |
| 6,702,633 | B1 | 3/2004 | Johnson |

OTHER PUBLICATIONS

Glenn Christiansen "Don't laugh. Its a bellyboat" Sunset magazine, Apr. 1982 pp. 106-109 Pertinet reference is page 108, last 2 sentences of Col. 1, through first 3 sentences of Col. 2, and middle of Col. 3. —Fishmaster Mfg. Co. address.
"Paddle Pushers" product literature sheet.
"Float Striders" Forward Propulsion Fins product literature sheet.

*Primary Examiner*—Ed Swinehart

(57) ABSTRACT

A heel mounted reversible fin assembly for propelling kick boats and float tubes in water. The assembly includes a base mounting mechanism (1) which secures the assembly on a user's boot heel, and an inter-connected generally perpendicularly inclined fin member (4) which extends below the user's boot sole. Apertures (52) extending through the fin blade (50) adjacent to cleavages (46) in ribs (47) define a hinge portion (49) about which the blade (50) flexes to feather on return kicks in the direction of the rear surface (48) of the blade (50). Raised ribs (47) extending generally perpendicularly outward from the rear surface (48) of the fin blade (50) inter-connect, providing a stop mechanism to retain the blade (50) in a generally rigid configuration on power kicks in the direction of its front surface (51). The deep under sole position of the fin blade (50) and flexure limiting ribs (47) co-operate to provide a "quiet" stealthy progress in water without the rebound splashing (SPL) and surface disturbances caused by conventional fins. In the preferred embodiment the mounting member (2) and fin member (4) are separate inter-connecting components by which the fin member (4) is reversible on the mounting member (2) to selectively propel either in a forward or backward direction.

21 Claims, 8 Drawing Sheets

HEEL MOUNTED DIRECTION REVERSIBLE STEALTH FIN

RELATED PATENT AND PROVISIONAL PATENT APPLICATION

This application is related to my U.S. Pat. No. 6,702,633 B1, dated Mar. 9, 2004, and my U.S. Provisional Patent Application No. 60/599,489, filed Aug. 6, 2004. It is entitled to the benefit of my Provisional Application No. 60/599,489.

BACKGROUND

1. Field of the Invention

This invention relates to foot fins used for propelling float devices such as kick boats (aka. pontoon boats) and float tubes which are commonly used in fishing and other aquatic pursuits. Specifically, the present invention relates to improvements to known propulsion devices whereby a heel mounted fin assembly which is adaptable to propel forward or backward can be attached to and removed from a user's boot while the user is seated on a float device, floating in shallow water.

2. Description of Prior Art

Most fins used for propelling float tubes and pontoon boats are similar to swim fins in which the fin blade extends in front of the user's toes. This forward extension restricts ankle movement, necessitating that a user of such fins must walk and wade backward with the inherent risks of tripping and falling exacerbated by the clumsiness of also carrying a float tube and related equipment while walking and wading backward. Paradoxically, while such forward extending fins propel an outstretched prone swimmer forward in the water, they propel a person seated on a float tube in a backward direction. While users of pontoon boats on moving streams prefer to propel backward to follow a course in the water, this is generally opposite the direction of movement preferred by still water fishermen who wish to move forward in casting and moving about on a body of water. Further, conventional fins create undesirable surface disturbances and splashing when their blades rebound from a flexed position at the end of each power kick.

Prior inventions have sought to overcome these problems by providing for forward movement in walking, wading, and propelling in water by utilizing various retractable and pivotal fin members, fin members mounted laterally to the sides of the user's legs and ankles, or in front of or behind the users legs or feet. Although it is necessary to provide retractable or laterally extending fins to allow users of torus or "donut" shaped float tubes to walk and wade with fin assemblies mounted to their boots, this provision is unnecessary for users of open-ended float tubes and kick boats who can simply wade to an appropriate depth of water, sit on the float device, and then mount the present fin to the heels of their boots.

SUMMARY OF THE INVENTION

The invention herein described discloses a compact heel mounted reversible fin assembly which is adaptable to propel in either a forward or backward direction in water, and which can be attached to and removed from a user's boot while he or she is seated floating in shallow water. Flexure limiting ribs and a deep under sole position of the present fin blade prevent undesirable splashing and surface disturbances which are frequently caused by forward extending conventional fins. Improvements provided by the present invention are as follows:

First, the fin blade of the present invention can be reversed to propel in either a forward or backward direction.

Secondly, the present fin assembly can be mounted to and removed from a user's boot, foot, or foot covering while the user is seated on a float device, thereby providing greater freedom of movement and safety from injury which might otherwise be sustained in tripping and falling while wading backward with conventional fins attached to the feet.

Third, also due to its heel mounting and under sole blade position the present fin propels in a "quiet" stealth manner which does not create the water disturbance and splashing of forward extending conventional fin blades.

Fourth, the fin is of lighter construction since it does not require retraction and latching mechanisms and the mass and weight of those mechanisms.

Fifth, the present invention is more reliable and trouble free, not prone to breaking, malfunction, or loss of parts of retraction and latch mechanisms.

Sixth, the compact size of the present fin provides greater ease of packing, transportation, and storage.

Finally, material and cost efficiencies achieved with a simple, compact fin allow the production of a competitively priced fin providing superior performance.

OBJECTS AND ADVANTAGES

Accordingly, several objects and advantages of the present invention are:

(a) to provide a reversible fin which is easily adaptable to propel in either a forward or backward direction.

(b) To provide a safer fin, which allows a user to walk and wade in a normal manner, unrestricted by the limitations of conventional fins which must be attached to the feet prior to entering the water.

(c) To provide a "quiet" stealth fin which does not cause the splashing and surface disturbances which are commonly produced by forward extending conventional fins.

(d) to provide a simple, lighter fin of superior performance to prior fins.

(e) to provide a fin with fewer protrusions which could become entangled in debris or structure in the water, thereby lessening the need for special safety release bindings.

(f) to provide an efficient fin of minimum mass which can be manufactured at lower tooling and part costs, providing a less expensive fin to the end user.

Still further objects and advantages will become apparent from a consideration of the ensuing description and drawings.

DESCRIPTION OF THE DRAWINGS

FIG. 1-B shows the same mounting of the fin assembly to the left boot, with the blade reversed to propel backward.

REFERENCE NUMERALS IN DRAWINGS

Figure 1A:
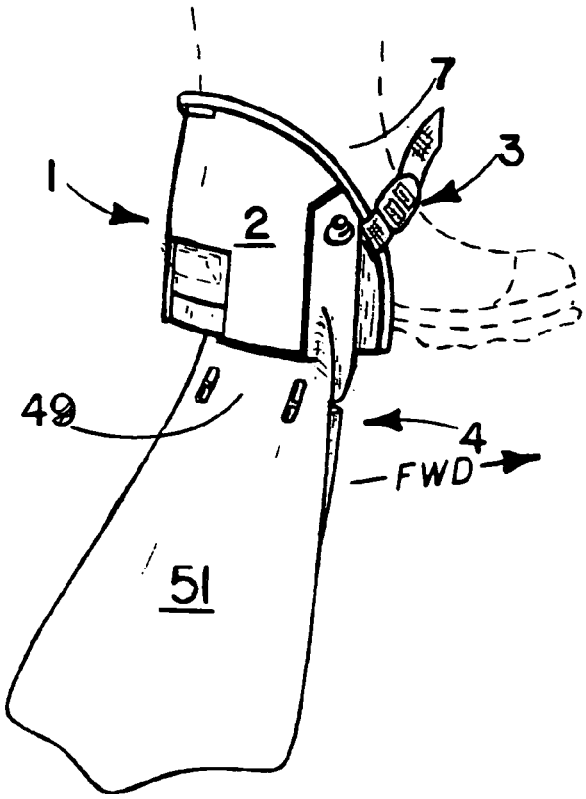
FIG. 1-A shows the present fin assembly mounted on the user's left boot, with the blade oriented to propel forward.

1 base mounting mechanism
2 heel cup
- 21 apertures—upper sides of heel cup for webbing
- 22 aperture—rear of heel cup for boot protrusion
- 23 aperture—rear of heel cup for fin savers
- 24 studs—bottom of heel cup for inter-connecting mechanism
- 25 apertures—sides of heel cup for retaining pins 61
- 26 bosses—sides of heel cup surrounding apertures 25
- 27 heel cup top rib

3 binding mechanism
- 31 buckle
- 32 webbing or strap

4 fin member
- 41 apertures—for inter-connection of heel cup studs 24
- 42 transverse portion of the fin member
- 43 connecting arms
- 44 apertures in connecting arms for retaining pins 61
- 45 counterbore in connecting arms for heel cup bosses 26
- 46 rib cleavages—(inter-connecting rib ends)
- 47 ribs
- 48 rear surface of fin member
- 49 hinge portion of fin member
- 50 fin blade
- 51 fin blade front surface
- 52 apertures in fin blade which form the hinge portion 49

6 Inter-connecting mechanism
- 61 retaining pins
- 62 cotter ring
- 63 apertures in retaining pins for cotter rings 62

7 boot or foot

DESCRIPTION OF THE PREFERRED EMBODIMENT

In the following description it should be understood that while a left boot and fin assembly are illustrated and described there are paired right and left boots and fin assemblies. The fin assemblies are identical and symmetrical as to their right and left sides, except that the binding buckles are positioned on the inside sides of each heel cup for ease in mounting the assemblies to the user's boots.

In preferred form the fin members and heel cups will be formed of an elastomer having appropriate physical characteristics of durability, memory, rebound, resistance to water absorption, etc. However, this should not be interpreted to exclude other materials which may meet or exceed performance requirements. Generally it is anticipated that parts will be formed by standard molding and manufacturing processes, although other methods of forming may also be used in producing the present fin assembly.

Figure 1B:
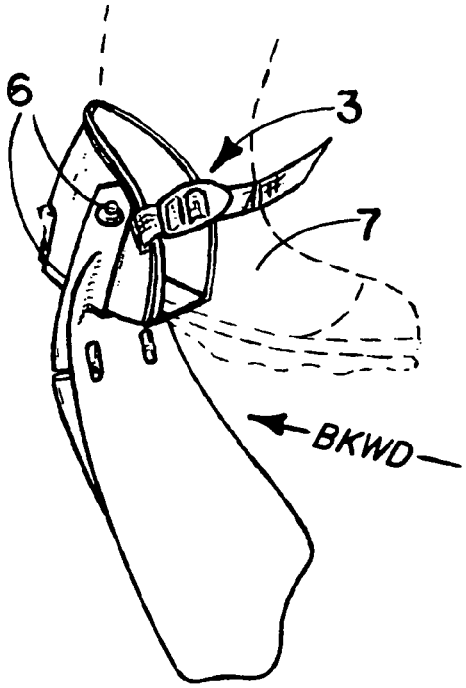

A reversible heel mounted fin assembly for attachment to a boot, foot, or foot covering of a user for propelling a float device such as a kick boat or float tube in water is shown as it would be assembled to propel forward in FIG. 1A, and as it would be assembled to propel backward in FIG. 1B. The assembly includes a base mounting mechanism 1 comprising a mounting structure or heel cup 2 and a securing mechanism or binding 3 which retains the mounting structure on the user's boot 7. A fin member 4 is attached to the heel cup 2 by an inter-connecting mechanism 6 which is shown in detail in FIG. 6. The mechanism 6 is constructed to allow the fin member 4 to be removed from the heel cup 2, reversed from its former position and re-attached to the heel cup 2 by the same mechanism to propel in the opposite direction. A detailed explanation of each of these sub-assemblies follows.

As previously discussed, the base mounting mechanism 1 includes a heel cup 2 and a securing mechanism or binding 3. The heel cup 2 is open at the top and front, and is shaped to generally surround the bottom, sides, and rear of the heel of a boot or foot, being universally sized and adapted to fit a range of sizes and styles of boot heels. A reinforcing rib 27 is formed around the opening of the heel cup to add a degree of stiffness and strengthen the structure. An opening or aperture 22 is formed in the lower portion of the rear wall of the heel cup 2 to allow a protrusion which is formed on the heel of some boots to pass through the heel cup 2 for a closer fit of the heel cup 2 to the boot 7. Optionally, an additional aperture 23 may be provided at the upper portion of the rear wall of the heel cup 2 for the attachment of a "fin saver", such as accessory straps which are presently sold for that purpose. Apertures 21 are formed in the upper front portion of the heel cup 2 adjacent to the rib 27 for attachment of the binding. The binding 3 includes straps or lengths of webbing 32 which are attached to the heel cup 2 by passing one end of each strap through a corresponding aperture 21 in the side of the heel cup 2. The end is then wrapped around the rib 27 of the heel cup 2, folded back against the remainder of the webbing 32 and fastened in this configuration by sewing or other suitable means. A releasable and length adjustable locking member, buckle, or fastener 31 is secured to the strap which is attached to the inside side of the heel cup 2 or alternately, by directly attaching the locking member 31 to the inside side of each heel cup 2. The locking members 31 are attached on the inside of each heel cup 2 for ease of connecting and securing the opposite strap through it to affix the fin assembly to the heel of a user's boot or foot 7. Although a simple one piece fastener commonly known as a ladder lock buckle is illustrated, other fasteners such as side release and cam buckles could also be used. The strap 32 which is attached to the outside side of the heel cup 2 should be of sufficient length to be easily grasped and inserted into the buckle by the fingers of one hand, while the other hand is used to support the fin assembly on the heel of the boot. Also, the end of this strap should be cut at an angle forming a pointed end to ease the process of starting it into the buckle.

Figure 6:
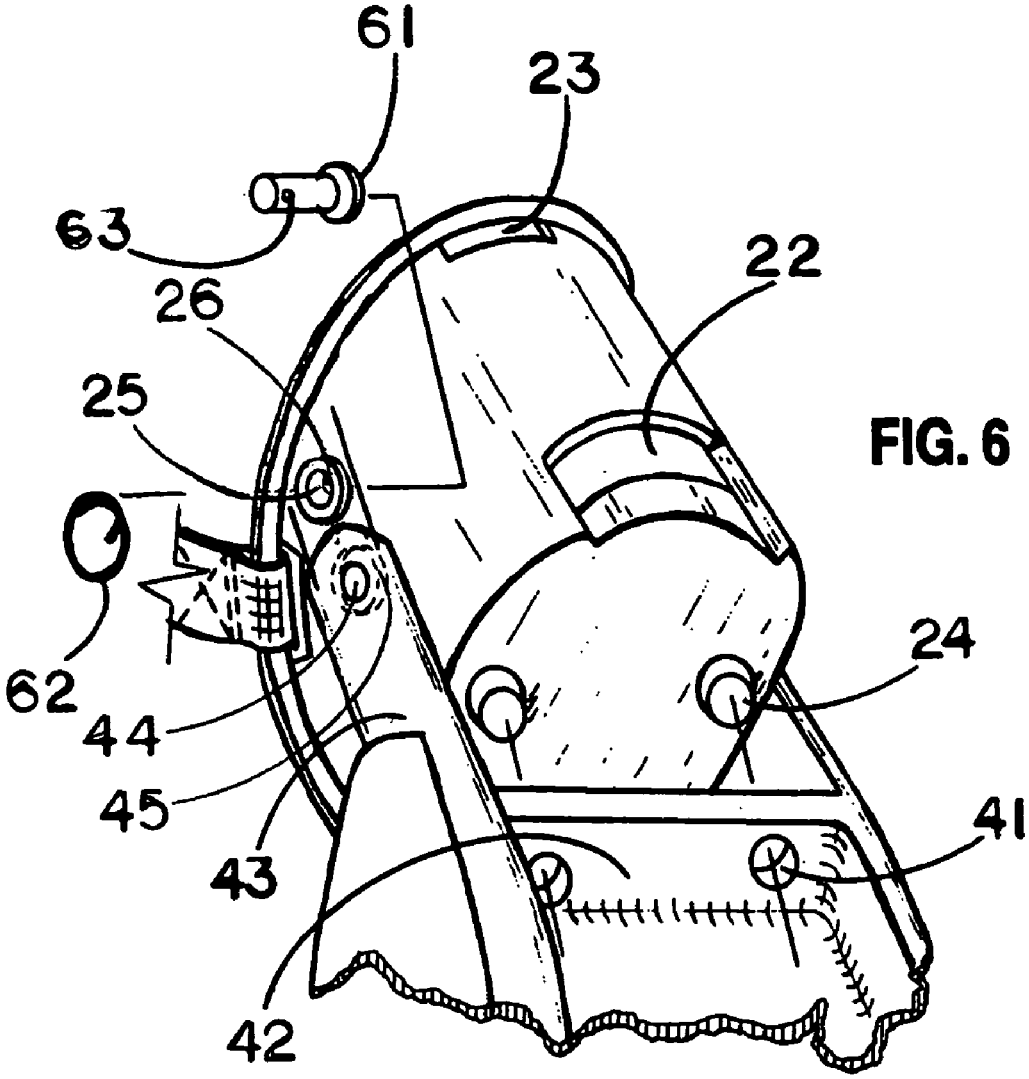
FIG. 6 is a partial "exploded" drawing showing details of the inter-connection of the fin member to the heel cup.

Details of the inter-connecting mechanism 6 are shown in FIG. 6. The mechanism 6 comprises interlocking structures on the bottom and upper sides of the heel cup 2 which mate with corresponding structures on the top transverse portion 42 and connecting arms 43 of the fin member 4. Protruding studs 24 formed on the underside of the heel cup 2 are sized and formed to pass through and connect with apertures 41 in the transverse portion 42 formed at the top of the fin member 4. Apertures 25 sized for corresponding retaining pins 61 are formed through each side of the upper portion of the heel cup 2. Raised boss structures 26 on the outside surfaces of the heel cup 2 are formed concentric with the apertures 25 to provide an increased surface to strengthen the connection of the heel cup 2 to the connecting arms 43 of the fin member 4. Counterbores 45 sized to receive the boss structures 26 are formed concentric with apertures 44 in the connecting arms 43 of the fin member 4. Both of the apertures 25 and 44 are appropriately sized and positioned for retaining pins 61 to pass through when the heel cup 2 and fin member 4 are assembled. The elastomer used in the fin member 4 and heel cup 2 shall be sufficiently pliable to allow the sides of the heel cup 2 to flex inward and the connecting arms 43 to flex outward enough to fit over the bosses 26 when coupling or removing the fin member 4 to or from its inter-connection with the heel cup 2. Split rings or cotter rings 62 pass through apertures 63 in the terminal end of each of the retaining pins 61 to secure the assembly. In the event of using an alternate mechanism to secure the assembly (such as molded snap fit or other manually operable mechanisms), substitutions should be designed "fail safe" wherein commonly available material such as fishing line or leader material could be used to perform the function of lost or broken parts.

Figure 13:
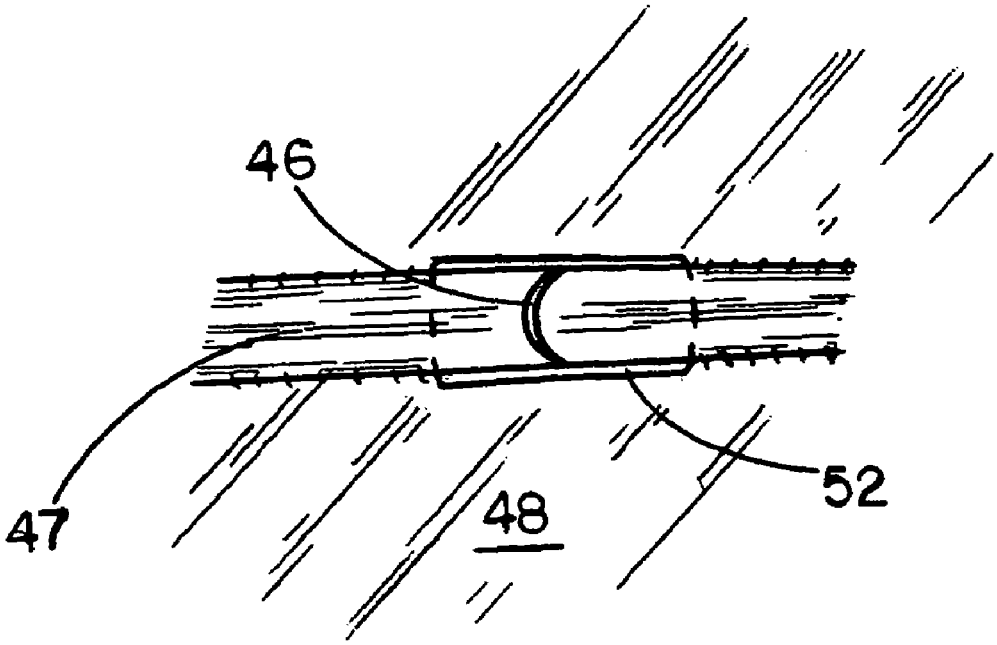
FIG. 13 is a detail drawing showing the interlocking shape of the rib ends at the hinge portion of the fin blade.

As shown in the accompanying drawings, when the fin member is assembled or coupled to the heel cup and mounted on the boot or foot 7 of a user, the blade 50 of the fin member 4 in its normal molded configuration extends below the plane of the sole of the user's boot or foot 7 at a generally perpendicularly or vertically inclined acute angle of the general plane of the broad front surface 51 of the fin blade 50 to the plane of the sole of the user's boot or foot 7. The relationship of the angle of the fin blade 50 to the plane of the sole of the boot or foot 7 (also the underneath surface of the heel cup) is important to the overall performance of the fin assembly, and will be discussed later in the specification. The broad front surface 51 of the fin blade 50 is formed as a generally shallow scooped concave planar surface transitioning into integrally formed connecting arms 43 which couple the fin member 4 with the base mounting mechanism 1 of the fin assembly, as discussed previously in the inter-connection of the fin assembly to the base mounting mechanism 1. The configuration of the concave front surface 51 of the fin blade 50 provides strength and some rigidity to the blade 50. Apertures 52 extend through the fin blade 50 near the inter-connecting end of the fin member 4 adjacent to cleavages 46 in raised ribs 47 which are formed on the rear surface 48 of the fin member 4. The ribs extend generally perpendicular to the rear surface 48 of the fin blade 50 and are aligned generally parallel to the length dimension of the fin blade 50, extending along a substantial portion of the length of the fin blade 50, fairing into the rear surface 48 of the fin blade 50 near the extreme end of the fin blade 50. The opposite ends of the ribs 47 transition into the connecting arms 43 which were previously described in the inter-connection of the fin member 4 to the heel cup 2. A transverse hinge portion 49 is formed across the fin blade 50 at the location of the apertures 52 and rib cleavages 46. The configuration of the hinge 49 and characteristics of the material used in the manufacture of the fin member 4 allow the fin blade 50 to flex, differentially varying the frontal surface which is applied against water in a to and fro kicking motion. A greater frontal surface is provided when the fin member 4 is advanced into the water in the direction of the front surface 51 of the fin blade 50, and a significantly reduced surface is provided when the fin assembly is kicked in a second opposite direction wherein the rear surface 48 of the fin blade 50 is moved into the water. The memory and rebound characteristics of the material from which the blade 50 is formed provide a bias for it to return to its molded configuration at the end of the reset kick, "setting up" in position for the next power kick. In use in a to and fro kick in the water, the ends 46 of the ribs 47 come in contact with each other in a power kick in the direction of the front fin surface 51, connecting as a stop mechanism to retain the fin blade 50 in a generally limited rigid position through the kick, while the hinge mechanism allows the fin blade 50 to feather on reset kicks in the direction of the rear surface 48 of the fin blade 50. The ends 46 of the ribs 47 are formed in an interlocking configuration as shown in the detail drawing of FIG. 13 to prevent stresses in a power kick from distorting the mating ends 46 of the ribs 47 which might otherwise allow them to slide past each other. Although a crescent shape is illustrated other interlocking shapes such as a U or V could also be used.

Figure 7:
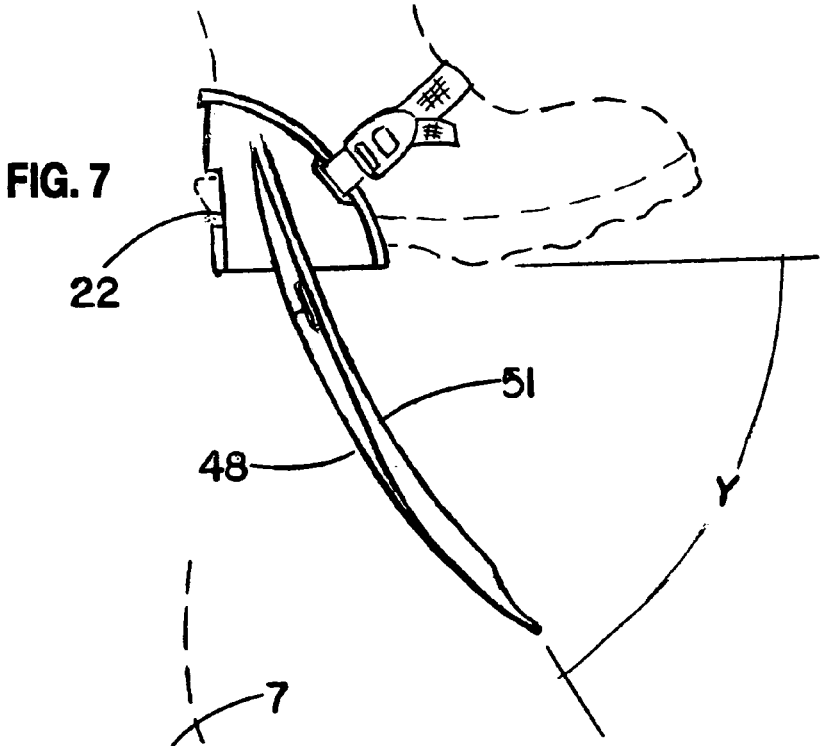
FIG. 7 shows a side view from the inside of the user's left leg illustrating an alternate one-piece fin formed to propel backward.
Figure 8:
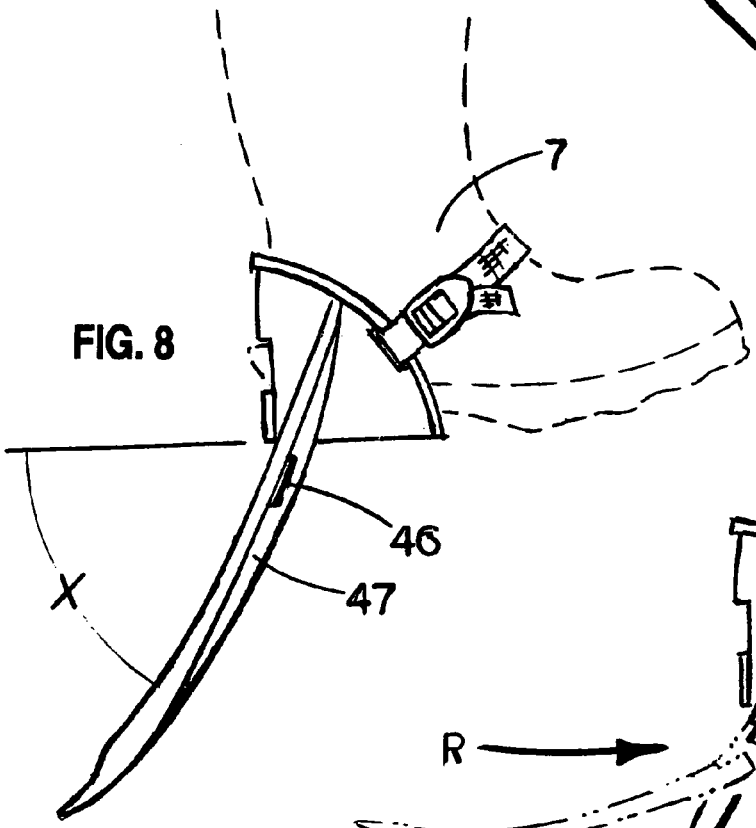
FIG. 8 shows a side view from the inside of the user's left leg illustrating an alternate one-piece fin formed to propel forward.
Figure 9:
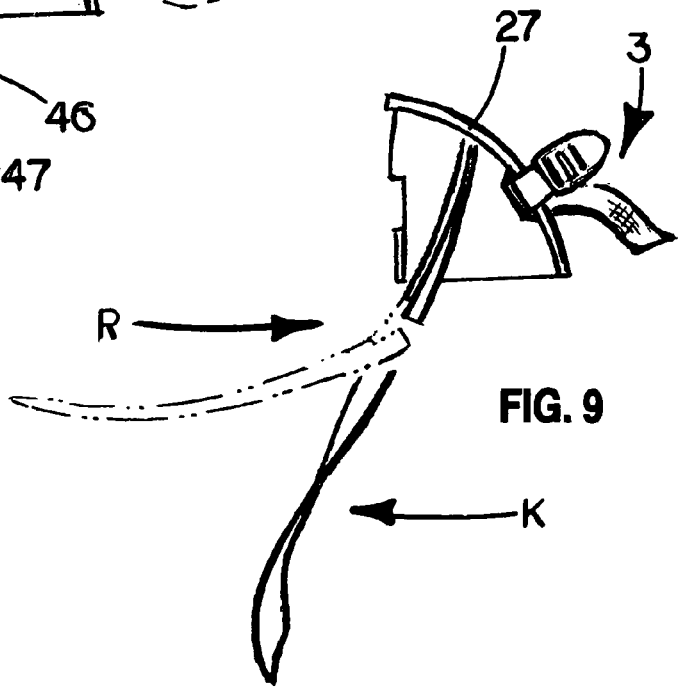
FIG. 9 shows the fin of FIG. 8 as it would appear when flexed in a power kick to the rear shown by an arrow (K) and in a feathered reset kick in a forward direction, illustrated by phantom lines and an arrow (R).

The angle of attack of the front surface 51 of the fin blade 50 throughout the arc of a kick relative to the plane of horizontal movement of a tuber on the surface of the water is important to the overall performance and efficiency of the fin assembly. An average optimum angle should be determined for fins formed in the material of choice by testing over an accurate measured distance in water, comparing various fin angles with float devices of various seating heights, and with the fins adapted to propel backward and also forward. I believe this angle expressed as an angle of the general plane of the front surface 51 of the fin blade 50 to the underneath surface of the heel cup 2 shown as angles X and Y in FIGS. 7 and 8 will be generally in the range of 650 to 800, but it should be adjusted accordingly if the optimum angle is found to be outside of this range.

DESCRIPTION OF ADDITIONAL EMBODIMENTS

Figure 11:
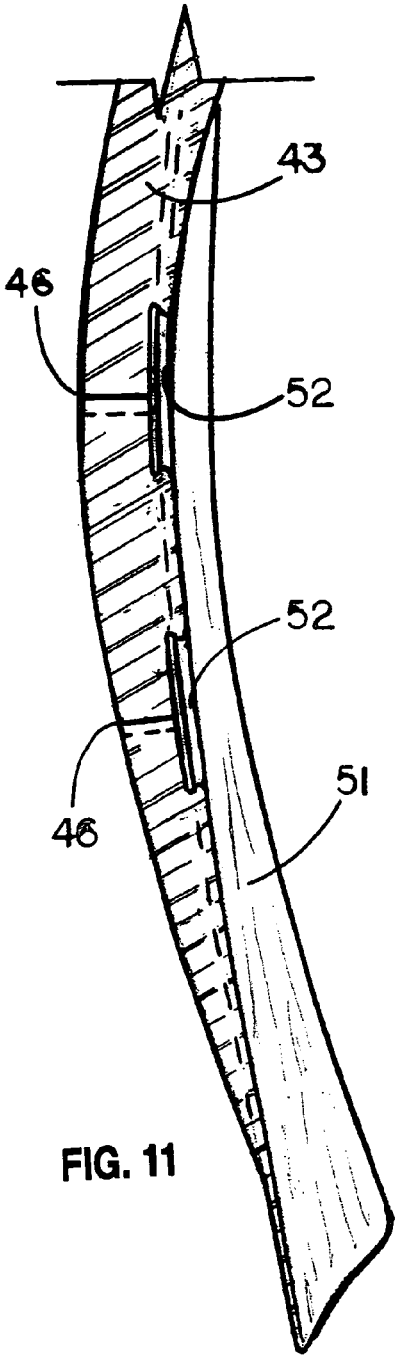
FIG. 11 is a lengthwise section drawing of an alternate rib and fin blade in which an additional hinge portion is formed in the fin blade.

One or more additional hinges in the fin blade as illustrated in FIG. 11 would reduce stresses which are concentrated on the single hinge previously illustrated and described and may also increase efficiency by reducing drag. The effect of additional hinges should be tested, and if proven to be of value, additional hinge positions as shown in FIG. 11 should be incorporated in the fin member 4.

Figure 12:
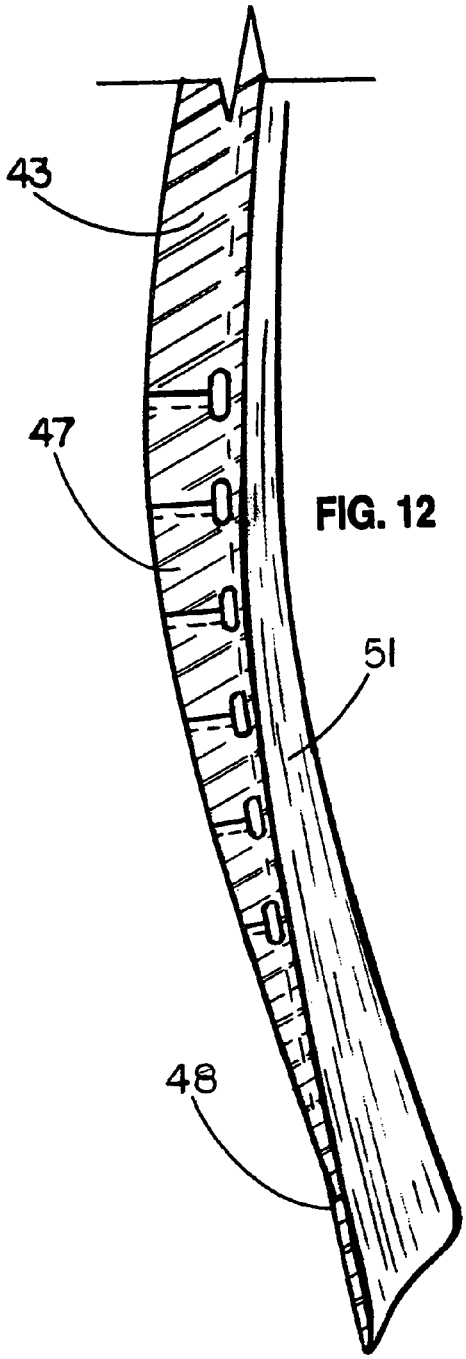
FIG. 12 is a lengthwise section drawing of a preferred alternate rib and fin blade in which a multiple segmented rib allows the fin blade to "seek its own flexure" along the general length of the fin blade.

A longitudinal cross section of an alternate preferred fin blade and rib is shown in FIG. 12. In this configuration the apertures 52 shown in the previously described preferred embodiments are deleted, providing a stronger uninterrupted continuous fin blade surface on which a plurality of interconnecting separate rib segments are integrally formed on the rear surface 48 of the fin blade 50, extending generally perpendicular to the rear surface 48 of the fin blade 50, being also aligned generally parallel to the lengthwise dimension of the fin blade 50, whereby a plurality of hinge portions transverse to the fin blade allow the blade to feather along the length of the rib portions, reducing stresses on the hinge by allowing the fin to "seek its own flexure" over a greater length of the fin blade 50 instead of the flexure being confined to a limited hinge portion 49. This rib design would probably be rather expensive to manufacture, needing to be incorporated as an insert in the molding process, but if a cost effective manufacturing process can be developed, I believe a multiple segmented rib as illustrated would improve both the performance and durability of the fin member 4, and an alternate design such as that shown or other alternate designs developed in testing should be incorporated in the present invention.

DESCRIPTION OF ALTERNATIVE EMBODIMENTS

Although specific structures and elements were shown and described in the foregoing description of the preferred embodiments, neither the deletion of some elements which are not directly related to the function of the present invention, nor the substitution of other elements for those described should be construed as evading the scope and claims of the invention as herein defined. Some examples follow:

The aperture 22 in the rear of the heel cup which provides for improved fit by allowing the protrusion on some boot heels to pass through the heel cup is non-essential to the operation and function of the fin assembly and could be eliminated. Likewise, the optional aperture 23 for the attachment of a "fin saver" could be eliminated.

The ladder lock buckle 31 which is illustrated and other buckles which are described could alternately be eliminated, substituting any of numerous over center or other adjustable strap and clamping mechanisms. The webbing 32 shown in the preferred embodiment could be replaced by flexible straps molded integral with the heel cup or otherwise attached. Such straps could be formed with a ratcheting length adjustment or other securement which would cooperate with different locking devices such as mechanisms used on some skates and ski boots.

The heel cup 2 and inter-connecting mechanism 6 could be replaced by attachment structures integrated in a boot whereby a fin member 4 could be attached to the boot 7 by various interlocking devices similar to the manner in which ski boots inter-connect with bindings, or structures of special bicycle shoes interconnect with "clip in" mechanisms used on co-operating bicycle pedals.

Figure 10:
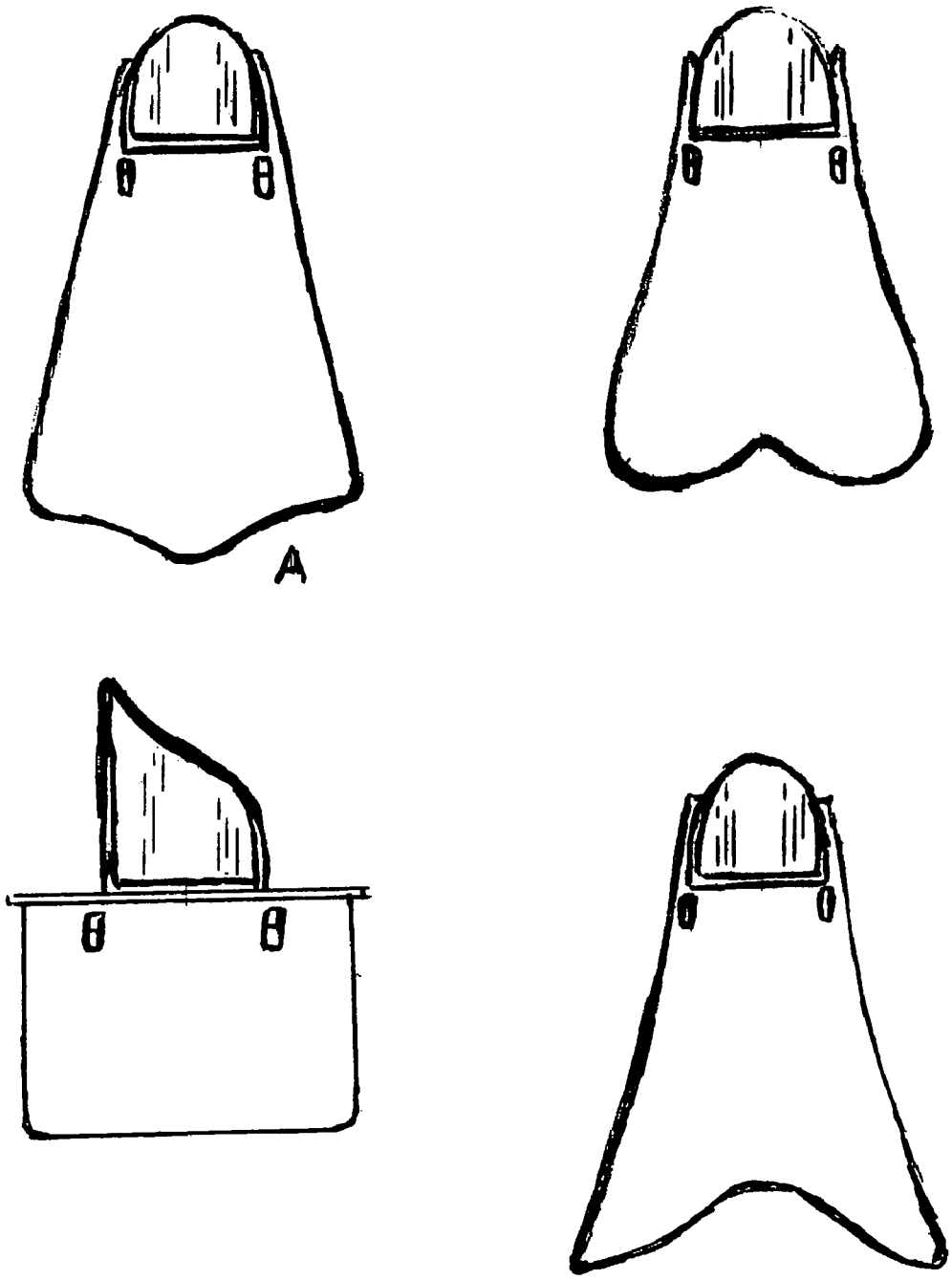
FIG. 10 shows a front view of various fins as illustrative examples of sane shapes which may be used for the fin blade.

Although a generic fin shape shown in FIG. 10A was illustrated in the specification, any other generally broad shape providing a substantial resistance to movement through water could be used for the fin blade. Some examples of other possible fin shapes are shown in FIG. 10.

A simpler one piece non-reversible fin assembly wherein the fin member and mounting structure are formed as a whole member, cooperating with the securing mechanism as a complete fin assembly which would propel only either forward or backward (such as the examples shown in FIGS. 7 and 8) could be constructed at lower cost than the reversible fin assembly shown in the preferred embodiment. However, similar one directional fins should still be interpreted as infringing the invention herein described.

Figure 14:
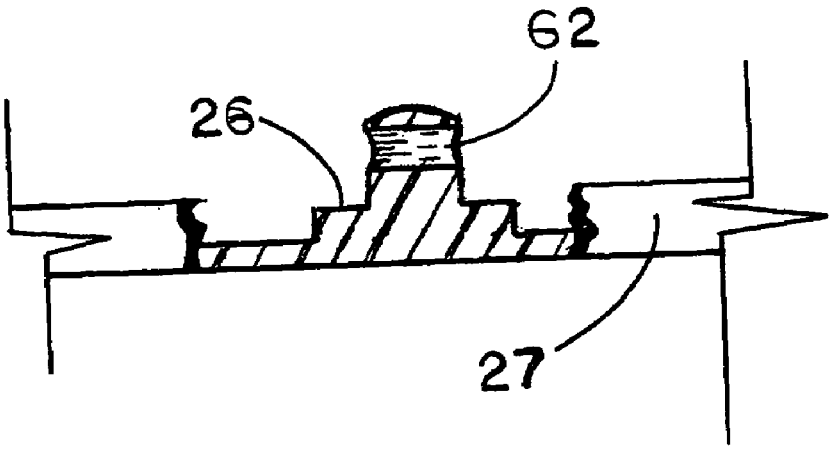
FIG. 14 is a detail drawing showing an alternate retaining mechanism in which an integrally molded stud replaces the separate retaining pin of the inter-connecting mechanism.

Different interlocking structures and mechanisms, such as manually releasable snap fit mechanisms which could be formed as part of the heel cup 2 and fin assembly 4 could be used in the inter-connection structures. Various changes could also be made to the interconnecting members described, and other means of securing the fin member 4 to the heel cup 2 (such as bolts and nuts and other pins and retainers) could be used. As another example, although it would not be as strong nor "fail safe" as the preferred embodiment which is shown and described, the separate retaining pin 61 could be replaced by a molded stud formed as an integral part of the heel cup 2 as shown in a section drawing in FIG. 14.

ADVANTAGES

Figure 2:
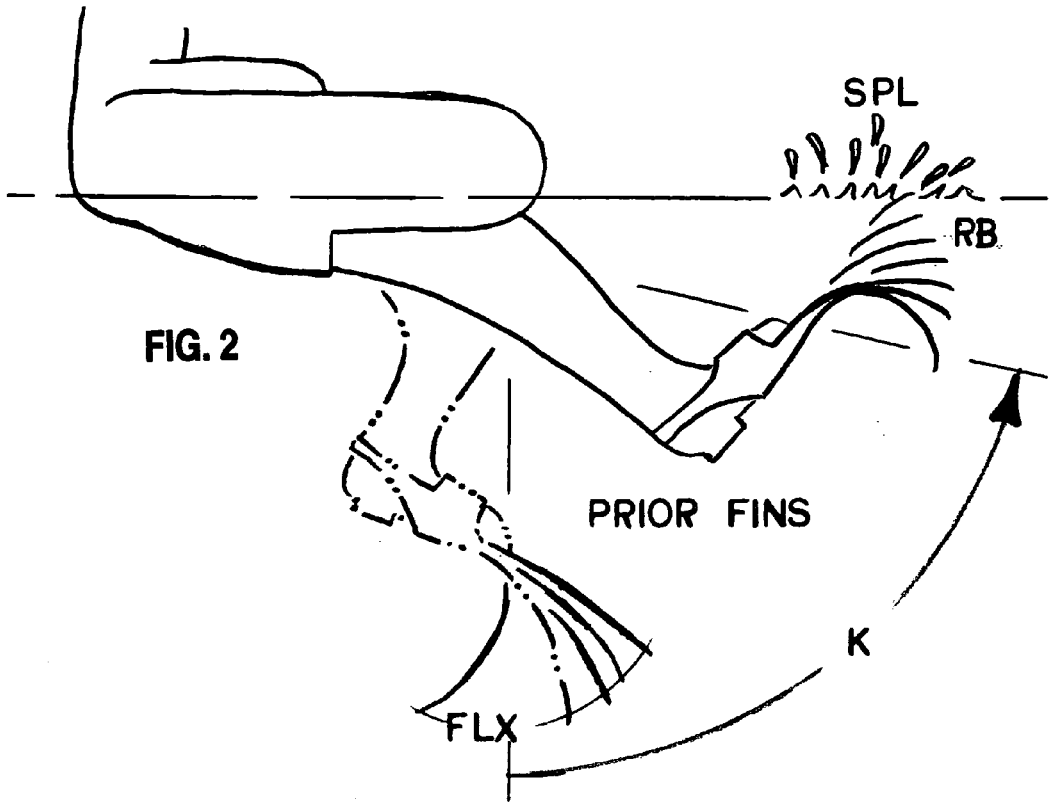
FIG. 2 is a side view illustrating the flexure of a prior fin blade in a power kick and the rebound of the fin blade at the end of the kick which causes splashing and surface disturbance.
Figure 3:
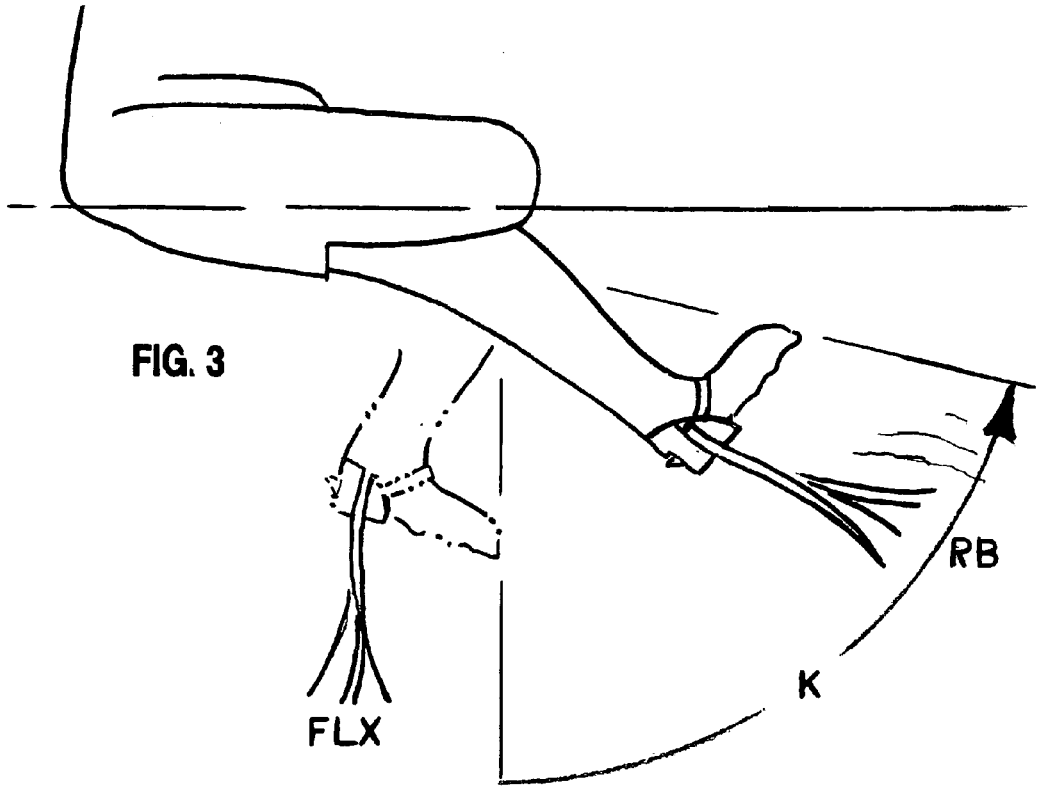
FIG. 3 is a side view illustrating the limited flexure of the blade of the heel mounted fin of the present invention, and its lower position in the water which prevents splashing and surface disturbance at the end of the kick.
Figure 4:
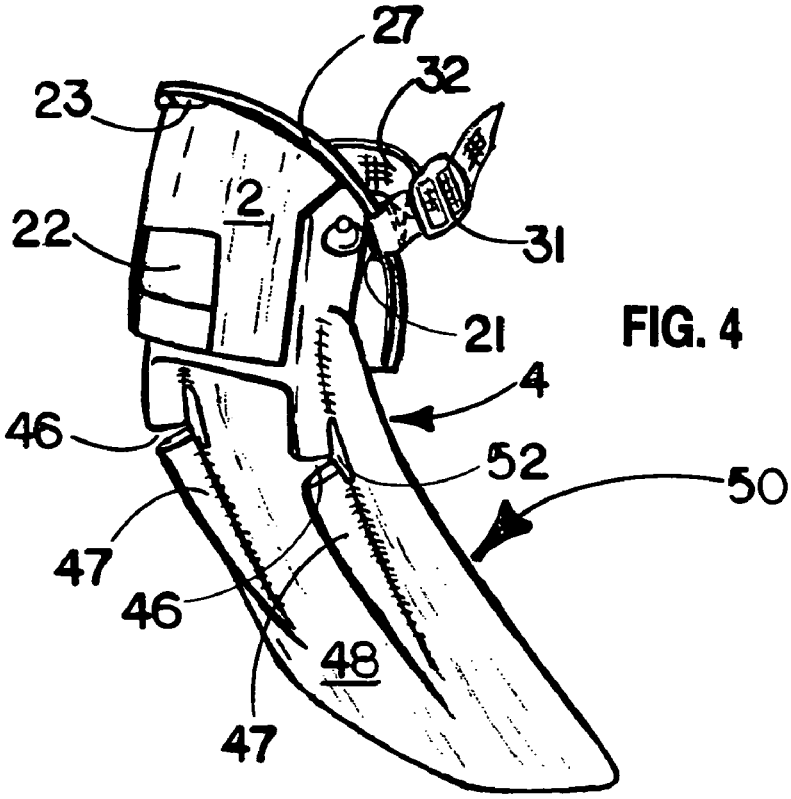
FIG. 4 is a rear quarter view of the present invention with the fin blade positioned for propelling backward.
Figure 5:
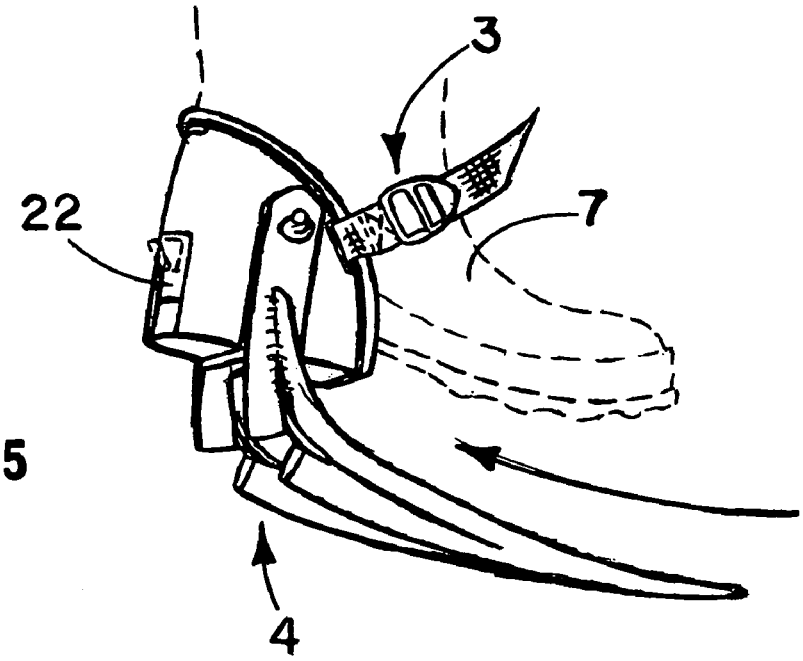
FIG. 5 shows a rear quarter view of the fin shown in FIG. 4 with the blade feathered as it would be in a reset kick to the rear.

From the foregoing description a number of advantages of the present heel mounted fin become apparent:

(a) The present fin assembly offers significant stealth advantages over conventional fins. In FIG. 2 it can be seen that in the arc of a power kick, represented by K the blade of a conventional fin first loads up from resistance of water against it, flexing as indicated by an arc FLX, remaining generally in that position through the power kick. At the end of the kick the fin blade rebounds to its molded configuration shown by RB, causing surface swirls and splashing SPL. FIG. 3 shows the present fin throughout the same arc of a power kick K in which the flexure limiting ribs, heel mounting, and deeper under sole position of the fin prevent splashing and surface disturbance.

(b) The present fin assembly also provides significant safety and "user friendly" benefits in providing for users to walk and wade forward in a normal manner unencumbered by fins on their feet, easily mounting and removing the fins when seated on their float tube in the water.

(c) The present fin offers broad appeal to all anglers, including those who wish to propel backward to troll or follow a course on moving water, and still water anglers who wish to propel forward in approaching a rise or targeting a cast.

OPERATION

To mount the fin assembly a user first should wade into the water, towing the float device to an appropriate shallow (knee deep) depth of water to sit floating on the device. The fin assemblies are attached by raising and crossing each leg in front over the opposite knee, holding the appropriate (right or left) fin assembly to the heel of the raised boot with one hand while using the other hand to pass the outside strap over the arch of the boot, finally inserting and tightening the strap in the buckle.

Use of the fins is intuitively ergonomic. The fin member automatically feathers and extends in a to and fro kicking motion which propels the user forward or backward, depending on the orientation of the fin member on the heel cup. Kicking to one side turns the user in the opposite direction.

To exit the water a user should first fin into a shallow depth near the desired point of exit. Next he or she would alternately raise each leg to remove the fin assemblies, then stand to wade from the water in a normal unrestricted manner.

I claim:

1. A fin assembly adapted for attachment to the heel of the boot or foot of a person seated aboard a kick boat or open float tube for propelling on water, said boot having an ankle, an instep, a sole, a toe, and a heel portion, said fin assembly comprising:

a fin member having an upper end portion adapted for reversible attachment to the same constant structures of a fin assembly mounting mechanism and an integral elongated fin blade extending from said fin member upper end portion, said fin blade having a first broad surface, an opposite second surface, a flexible upper hinge portion, a lower end portion, and opposing side portions, said lower end portion of said fin blade having a width dimension greater than said upper end portion of said fin member, said fin blade extending downwardly below the plane of the underneath surfaces of said heel and said sole of said boot, said broad surface of said fin blade being aligned transverse to said sole of said boot, said fin blade hinge portion including a hinge mechanism urging said fin blade to a normal fully extended generally rigid planar configuration offering a maximum resistance to movement of said broad surface of said fin blade against water, yet which said hinge mechanism allows said fin blade to feather, flexing in the direction of said broad surface of said fin blade in response to the resistance to movement of water surrounding said fin blade when said second surface of said fin blade is moved against water, said broad surface of said fin blade in a fully feathered configuration being more parallel to the plane of said heel and said sole of said boot than when said fin blade is freely positioned in its said normal fully extended configuration, said second surface of said fin blade offering substantially reduced resistance to movement against water as a means of generating a differential force in a to and fro kicking motion of said fin assembly to propel said person on water;

said fin assembly mounting mechanism being adapted to fit said fin member to said heel of said boot, said fin assembly mounting mechanism including a means for releasable attachment of said fin assembly to said heel of said boot, said fin assembly mounting mechanism providing a means of reversibly attaching said fin member to said same constant structures of said fin assembly mounting mechanism whereby the relative position of said broad surface of said fin blade to said toe and said heel of said boot can be aligned in either a forward facing or backward facing position to propel said person backward or forward on water, said fin assembly being removable from said heel of said boot by said person from a seated position on said kick boat or open float tube floating on water;

whereby a person can don the present fin assembly from a seated position on a kick boat or open float tube floating on water to selectively propel either in a forward or backward direction on water and can remove said fin assembly while floating in shallow water to disembark, wading and walking in a normal unrestricted manner.

2. The fin blade of claim 1, wherein the angle of the plane of said broad surface of said fin blade extending downwardly below said plane of said underneath surfaces of said heel and said sole of said boot is an acute angle between 65° and 80°.

3. The fin assembly mounting mechanism of claim 1, wherein said fin assembly mounting mechanism is a heel cup which is open at the top and front, shaped to generally surround the bottom, sides, and rear of the heel of a boot; said heel cup having a reinforcing rib extending around the top and front edges of said heel cup to which said means for releasable attachment of said fin assembly to said heel of said boot is fastened.

4. The heel cup of claim 3 in which said means for releasable attachment of said fin assembly to said heel of said boot is a length of webbing or a strap fastened to said rib on the outside side of said heel cup, passing over said instep of said boot for connection to a length adjustable releasable buckle fastened to said rib on the inside side of said heel cup.

5. The heel cup of claim 3 which includes an aperture centered in the lower portion of the rear wall of said heel cup, said aperture being sized and configured for a protrusion formed on the heel of a wading boot to pass through for a close fit of said heel cup to said heel of said boot, the upper surface of said aperture connecting with the upper surface of said protrusion on said heel of said boot.

6. The heel cup of claim 3 which includes a narrow aperture centered in the upper portion of said rear wall of said heel cup adjacent to said reinforcing rib, said narrow aperture being sized for attachment of an optional tether strap or additional binding strap for close attachment of said fin assembly mounting mechanism to said ankle of said boot.

7. The heel cup of claim 3 which includes one or more protruding structures on the underneath surface of said heel cup and on both outer sides of the upper portion of said heel cup which reversibly connect with corresponding apertures and recesses in co-operating structures of said upper end portion of said fin member, each of said protruding structures on said outer sides of said upper portion of said heel cup being concentrically located to an aperture extending through said protruding structure and the wall of said heel cup.

8. The fin member of claim 1 wherein said broad surface of said fin blade is formed as a generally shallow concave planar surface transitioning into similar paired integrally formed connecting arms of said fin member upper end portion; an aligned laterally transverse aperture being formed through both of said connecting arms near to the terminal end of said connecting arms, a recess concentric to said aperture being formed in the inner surface of each of said connecting arms, said recesses being sized and configured to reversibly couple with the same constant corresponding said protruding structures on said outer sides of said heel cup, said aperture through said connecting arms being in parallel alignment with corresponding apertures formed through said protruding structures and said wall of said upper portion of said heel cup when said fin member is assembled to said heel cup.

9. The fin member of claim 1 wherein said second surface of said fin blade includes one or more raised longitudinal ribs extending generally perpendicular to said second surface of said fin blade, said longitudinal ribs running along a substantial portion of the length of said fin blade, fairing into said second surface of said fin blade near said lower end portion of said fin blade, transitioning at the opposite upper portion of said fin blade into said integrally formed connecting arms of said fin member upper end portion; said longitudinal ribs and said connecting arms at their interface being interconnected by a raised transverse rib extending generally perpendicular to said second surface of said fin member, the upper surface of said transverse rib being adjacent to the underneath surface of said heel cup when said fin member is assembled to said heel cup, said transverse rib having one or more apertures through said upper surface of said transverse rib which reversibly connect with corresponding said protruding structures on said underneath surface of said heel cup.

10. The apertures through said connecting arms of said fin member, and said apertures through said protruding structures and said upper sides of said heel cup in claim 8 which receive a correspondingly sized and configured pin passing through each of both said apertures, said pin having a flanged head formed on one end thereof and a transverse aperture formed through the opposite end of said pin to receive a cotter ring for manually releasable secure attachment of said fin member connecting arms to said upper sides of said heel cup.

11. The ribs of claim 9, wherein a plurality of spaced transverse cleavages through each of said longitudinal ribs determine said hinge portion of said fin blade, said cleavages being centrally positioned adjacent to and connecting with corresponding spaced elongated apertures extending through both surfaces of said fin blade, said cleavages and said corresponding apertures being in parallel alignment across the width of said fin blade forming a plurality of flexible hinges across the width of said upper portion of said fin blade.

12. The hinge mechanism of claim 1 wherein said hinge mechanism includes a stop means wherein contact of the opposite end faces of said cleavages through said longitudinal ribs prevents additional flexure of said fin blade beyond the point of contact of said rib end faces, yet said hinge mechanism allows said fin blade to flex in the opposite direction against resistance from the configuration in which said fin blade is formed and the characteristics of the composition of the material from which said fin blade is constructed urging said fin blade to its normal fully extended configuration.

13. The hinge mechanism of claim 1 wherein a plurality of spaced narrow elongated transverse apertures are formed through said longitudinal ribs at said hinge portion of said fin blade, said transverse apertures being adjacent to and parallel to said second surface of said fin blade and in parallel alignment across the width of said fin blade, said transverse apertures being centrally located below and connecting with corresponding cleavages through the outer raised portion of said longitudinal ribs forming said hinge portion of said fin blade with a plurality of multiple rib segments and a continuous uninterrupted said fin blade surface.

14. The fin assembly of claim 1 wherein said fin member and said fin assembly mounting mechanism are formed as a one piece integral assembly, co-operating with said means for securing said fin assembly mounting mechanism to said heel of said boot as a complete fin assembly.

15. The complete fin assembly of claim 14 wherein said broad surface of said fin blade is oriented to the front of said fin assembly mounting mechanism to propel said person backward.

16. The complete fin assembly of claim 14 wherein said broad surface of said fin blade is oriented to the rear of said fin assembly mounting mechanism to propel said person forward.

17. A fin assembly for releasable attachment to the heel of a boot for propelling a kick boat or float tube in water, said fin assembly including a broad elongated fin member extending below the heel of said boot at an acute angle of between 65° and 80° to the plane of the underneath surface of said heel and the sole of said boot, the broad surface of said fin member being aligned transverse to said heel and sole of said boot, said fin member including a hinge portion across the width of the upper portion of said fin member wherein a hinge mechanism and a stop mechanism co-operate to retain the blade of said fin member in a normal extended generally rigid configuration when said broad surface of said fin member is moved into water in a first direction, said hinge mechanism allowing said fin member to feather when said fin member is moved into water in a second opposite direction, said blade when fully feathered being aligned generally more parallel to the plane of the underneath surface of said heel and sole of said boot than when said fin member is in its said normal extended configuration, whereby the broad frontal surface and the opposite reverse side of said fin member applied against water in a to and fro kicking motion of said person's feet and legs offer a differential resistance to movement against water to provide a force against water to propel a person on water; said fin assembly including a mounting mechanism for releasable attachment of said fin member to said heel of said boot, said mounting mechanism being universally adapted to fit a range of sizes and styles of boot heels, and including structures which reversibly mate with the same constant corresponding co-operating structures of said fin member, whereby said fin member can be interconnected to the same constant said structures of said mounting mechanism facing in either a forward or backward direction to propel said person in the opposite direction, said mounting mechanism releasably attaching said fin member to said heel of said boot by an adjustable binding mechanism suitable for manual operation by a person seated on a kick boat or open float tube floating on water.

18. The mounting mechanism of claim 17 which is a heel cup open at the top and front, shaped to generally surround the bottom, sides, and rear of said heel of said boot; said heel cup having a reinforcing rib surrounding the top and front edges to which said binding mechanism is attached, said binding mechanism comprising a strap attached to said rib on the outside side of said heel cup, and a length adjustable releasable buckle fastened to the inside side of said heel cup, said strap passing over the instep of said boot to connect with said buckle.

19. The hinge portion and stop mechanism of claim 17, wherein a plurality of spaced transverse cleavages through raised longitudinal ribs formed perpendicularly on the reverse side of said fin member define said hinge portion of said fin member in which a transverse parallel alignment of said cleavages through said ribs connecting with a plurality of corresponding spaced narrow elongated transverse apertures through said ribs adjacent to and parallel to the surface of said reverse side of said fin member provide a flexible said hinge portion allowing said fin member to flex in the direction of the forward said broad surface of said fin member, yet said fin member is prevented from flexing in the opposite direction of said reverse side of said fin member by contact of the end faces of said ribs at said cleavages.

20. The hinge portion and stop mechanism of claim 17, wherein said hinge portion is a flexible portion of said fin member defined by a plurality of spaced transverse cleavages through raised longitudinal ribs formed perpendicularly on the reverse side of said fin member adjacent to and connecting with corresponding spaced elongated apertures through both surfaces of said fin member, said cleavages and said apertures being in a parallel transverse alignment acoss the width of said fin member forming a flexible hinge portion of said fin member.

21. A method for propelling a kick boat or open float tube in either a forward or backward direction on water, and of providing a means whereby a user of said method of propelling a kick boat or open float tube can walk and wade on boot soles in a normal unrestrained manner, thereby increasing the user's safety and efficiency in walking whether in or out of a water environment comprising:

(a) providing a pair of fin members constructed to maintain a broad frontal surface when moved against water in a first direction, while feathering to provide a substantially reduced frontal surface when moved in a second opposite direction in water, said fin members being adapted for reversible assembly to the same constant structures of mounting mechanisms which are adapted for releasable attachment to the heels of a pair of boots worn by a fisherman or other person using the device, (b) providing a pair of mounting mechanisms fitted for releasable attachment to said heels of said pair of boots by a binding mechanism, said mounting mechanisms being adapted for reversible assembly of said fin members to the same constant structures of said mounting mechanisms with the blades of said fin members extending generally downwardly below the plane of the underneath surfaces of each of said mounting mechanisms, (c) assembling said fin members to said mounting mechanisms with said broad surfaces of said fin members facing opposite to the desired direction of movement on water of said fisherman or other said person using said device, (d) providing a kick boat or open float tube, a user of the device pushing or towing said kick boat or open float tube while wading to an approximate knee deep depth of water, said user sitting down upon the seat of said kick boat or open float tube when in an appropriate depth of water, and (e) mounting a pair of the fin assemblies of step (c) from a seated position aboard said kick boat or open float tube while floating on water, one to said heel of each said boot by raising and crossing each leg in turn over the knee of the opposite leg, fitting said mounting mechanisms to said heels of said boots and securing said mounting mechanisms to said boots by attaching a mounting strap fastened to the outside side of each of said mounting mechanisms over the instep of each said boot to buckles fastened to the inside sides of each of said mounting mechanisms, adjusting the length of each said strap through each said buckle for a secure attachment of said mounting mechanisms and said fin members to said heels of said boots, (f) propelling about on water by a to and fro kicking motion of said user's feet and legs, and finally, to exit, (g) propelling to an appropriate approximate knee deep depth of water near to the edge of the water at a desired point of exit, said user raising each leg in turn to remove each of said fin assemblies, and (h) standing to wade and exit the water, towing or pushing said kick boat or open float tube to the edge of the water, whereby a user can walk and wade on boot soles in a normal forward direction unrestricted by fins, mounting the present fin assembly from a seated posture while floating on a kick boat or open float tube, and also removing the present fin assembly from a seated floating posture to exit a body of water, wading and walking in a normal forward direction unrestricted by fins, the present fin assembly thereby contributing greatly to the safety and enjoyment of using a kick boat or open float tube.

* * * * *

UNITED STATES PATENT AND TRADEMARK OFFICE

CERTIFICATE OF CORRECTION

PATENT NO. : 7,134,927 B1
APPLICATION NO. : 11/198766
DATED : November 14, 2006
INVENTOR(S) : Carroll L. Johnson It is certified that error appears in the above-identified patent and that said Letters Patent is hereby corrected as shown below:

Column 6, lines 49 and 50, formerly printed as follows:

[~~in the range of 650 to 800,~~ ]

Should read as follows:

<u>in the range of 65° to 80°.</u>

Signed and Sealed this

Thirtieth Day of January, 2007

JON W. DUDAS
*Director of the United States Patent and Trademark Office*